US007627966B2

(12) United States Patent
Koch et al.

(10) Patent No.: US 7,627,966 B2
(45) Date of Patent: Dec. 8, 2009

(54) OFF-FALL CONTROL FOR A TRENCHING OPERATION

(75) Inventors: Roger D. Koch, Pekin, IL (US); Robert J. Price, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 490 days.

(21) Appl. No.: 11/495,554

(22) Filed: Jul. 31, 2006

(65) Prior Publication Data

US 2008/0022564 A1 Jan. 31, 2008

(51) Int. Cl.
*E02F 5/02* (2006.01)

(52) U.S. Cl. ..... 37/348; 37/195

(58) Field of Classification Search ..... 37/348, 37/443, 195, 466; 172/2–11; 414/694, 699, 414/708; 701/50
See application file for complete search history.

(56) References Cited

U.S. PATENT DOCUMENTS

| | | | | |
|---|---|---|---|---|
| 4,023,288 | A | 5/1977 | Roe | |
| 4,698,926 | A | 10/1987 | Caplis et al. | |
| 4,945,663 | A | 8/1990 | Nilsson | |
| 4,974,349 | A | 12/1990 | Timmons | |
| 5,065,326 | A * | 11/1991 | Sahm | 701/50 |
| 5,067,569 | A | 11/1991 | Gilcrease | |
| 5,398,430 | A | 3/1995 | Scott et al. | |
| 5,461,803 | A * | 10/1995 | Rocke | 37/443 |
| 5,493,798 | A | 2/1996 | Rocke et al. | |
| 5,572,809 | A | 11/1996 | Steenwyk et al. | |
| 5,596,824 | A | 1/1997 | Scott et al. | |
| 5,918,389 | A | 7/1999 | Hall | |
| 6,510,628 | B1 | 1/2003 | Koch | |
| 6,604,305 | B2 | 8/2003 | Koch | |
| 6,725,142 | B2 | 4/2004 | Koch | |
| 6,757,994 | B1 | 7/2004 | Hendron | |
| 6,819,993 | B2 | 11/2004 | Koch | |
| 6,915,599 | B2 | 7/2005 | Lohnes et al. | |
| 6,928,758 | B1 | 8/2005 | Stout | |
| 7,007,415 | B2 | 3/2006 | Koch | |
| 7,010,367 | B2 | 3/2006 | Koch et al. | |

FOREIGN PATENT DOCUMENTS

| | | |
|---|---|---|
| GB | 1142863 | 2/1969 |
| JP | 7305375 | 11/1995 |
| JP | 2001-248187 | 9/2001 |
| WO | WO 98/06908 | 2/1998 |

* cited by examiner

*Primary Examiner*—Robert E Pezzuto
(74) *Attorney, Agent, or Firm*—Finnegan, Henderson, Farabow, Garrett & Dunner

(57) ABSTRACT

A system is provided for controlling off-fall during trench excavation. The system includes a trench excavating assemblage. A mechanism moves the trench excavating assemblage from a position within a trench to be excavated to a position for dumping excavated material. A control system is configured to operate the trench excavating assemblage in an automated off-fall control mode to remove and/or compact off-fall along at least one edge of the trench.

19 Claims, 5 Drawing Sheets

OFF-FALL CONTROL FOR A TRENCHING OPERATION

TECHNICAL FIELD

This disclosure relates to off-fall control for a trenching operation and, more particularly, to a method and a system for automated control of off-fall that accumulates along the edge of a trench excavation.

BACKGROUND

Many machines have been developed for excavating trenches. One commercially available type of machine often used for a trenching operation is a backhoe. Generally, a backhoe is mounted on a tractor or other machine moveable along the ground on wheels or tracks. The backhoe may be the only excavating assemblage or earth handling implement on the tractor or machine, or it may be one of a plurality of implements. For example, one relatively common machine, generally known as a backhoe loader, may include a backhoe mounted at one end of a tractor, and may include a loader bucket and accompanying operating linkage mounted at the other end of the tractor.

A typical backhoe may include a boom, a stick, and a bucket. In general, the boom may be pivoted to the machine for movement in a generally vertical plane, the stick may be pivotally mounted to the boom for movement in the same generally vertical plane, and the bucket may be pivotally mounted to the stick. Each of the boom, stick, and bucket may be moved about a pivotal connection by one or more actuators, such as hydraulic cylinders. The entire excavating assemblage of boom, stick, and bucket may be mounted on the machine for swinging movement in a generally horizontal plane.

In excavating a trench, the operator of a machine, such as a backhoe, manipulates the machine controls to cause the boom, stick, and bucket to move in coordination such that the bucket digs into the earth generally along the direction of extent of the trench. The bucket is moved about its pivot to become filled with earth, the filled bucket is held in a curled position and lifted by coordinated movement of the boom and stick from the trench being formed, and the assemblage of boom, stick, and bucket is then swung away from the trench for dumping, either into a pile adjacent the trench, or into a waiting container or carrier, such as a dump truck.

Another machine which also features an implement similar to a backhoe is generally known as a hydraulic excavator. The hydraulic excavator has several features in common with the backhoe of a backhoe loader, except that the boom, stick, and bucket assemblage of the hydraulic excavator does not swing in a horizontal plane relative to the machine. Rather, in a hydraulic excavator, the entire upper body of the machine rotates relative to the lower body or undercarriage. By rotating the entire upper body, the angular position of the boom, stick, and bucket about a vertical axis and relative to the worksite is adjusted.

During the process of lifting the filled bucket from the trench being formed, and/or during the process of swinging the assemblage to the off-loading position for dumping, a portion of the excavated earth may fall along the edge of the trench as "off-fall." This loose material along the edge of the trench, or off-fall, may fall back into the trench, either during the process of excavating the trench, or subsequently when other activities occur adjacent and/or within the trench.

If off-fall reenters the trench before access to the trench is lost, the problem may be resolved, and the off-fall removed, by reexcavating to remove the off-fall that has reentered the trench. Such reexcavating may be accomplished by the same machine employed in excavating the trench. Alternatively, reexcavating may be accomplished by a different machine. However, reexcavating, whether by the same machine, a different machine, or even manually, may result in inefficiencies, such as increased time, labor, and expense.

If the off-fall reenters the trench during concrete pouring, or shortly after concrete is poured and not yet cured, the off-fall may foul the concrete. This may weaken the concrete or, if on the surface of the concrete, it may require careful, manual removal of the soil. Whether off-fall reenters the trench during the process of excavating, or whether it is dislodged into the trench by subsequent activities, removal of the off-fall necessitates additional time and labor and results in decreased productivity. If the off-fall is merely left in the trench where it falls, or if it becomes mixed with poured concrete, the result is decreased quality of work. Some efficient manner of controlling the adverse consequences of loose off-fall would be both beneficial and desirable.

A backhoe with an attached compacting roller is disclosed in U.S. Pat. No. 4,974,349 issued to Timmons. In the Timmons patent, a compacting roller is attached to the back of the backhoe bucket. The compacting roller may be used for compacting material in the trench being excavated. The compacting roller may remain attached to the bucket while the bucket is used for excavating.

While the arrangement in the Timmons patent may be useful for compacting material within the trench, the Timmons patent does not disclose controlling, removing, or compacting off-fall, much less automating off-fall removal or compaction. Furthermore, the compacting roller is an additional element that may increase cost and require assembly and disassembly.

Off-fall adjacent the trench edge may be cleaned manually or by a machine under operator control. However, both manual cleaning and cleaning by machine under operator control may result in inefficiencies. Manual cleaning is time consuming and may increase labor costs. Cleaning by machine under operator control may require a high level of skill may result in inaccurate work, including incomplete removal of off-fall.

The disclosed off-fall control method and system are directed toward improvements and advancements over the foregoing technology.

SUMMARY OF THE INVENTION

In one aspect, the present disclosure is directed to a system for controlling off-fall during trench excavation. The system comprises a trench excavating assemblage. A mechanism is provided that is configured to move the trench excavating assemblage from a position within a trench to be excavated to a position for dumping excavated material. A control system is configured to operate the trench excavating assemblage in an automated off-fall control mode to remove and/or compact off-fall along at least one edge of the trench.

In another aspect, the present disclosure is directed to a method of controlling off-fall during trench excavation. The method includes excavating a trench by moving an excavating assemblage, including an excavating implement, into the earth. The method additionally includes lifting the excavating assemblage from the trench with the excavating implement containing earth. The method further includes moving the excavating assemblage away from the trench to a position for dumping the earth contained in the excavating implement. Additionally, the method includes moving the excavating implement into contact with or adjacent off-fall along at least one edge of the trench. Also, the method includes initiating an automated off-fall control mode, and controlling off-fall along the at least one edge of the trench via the excavating assemblage operating in the automated off-fall control mode.

DETAILED DESCRIPTION

Figure 1:
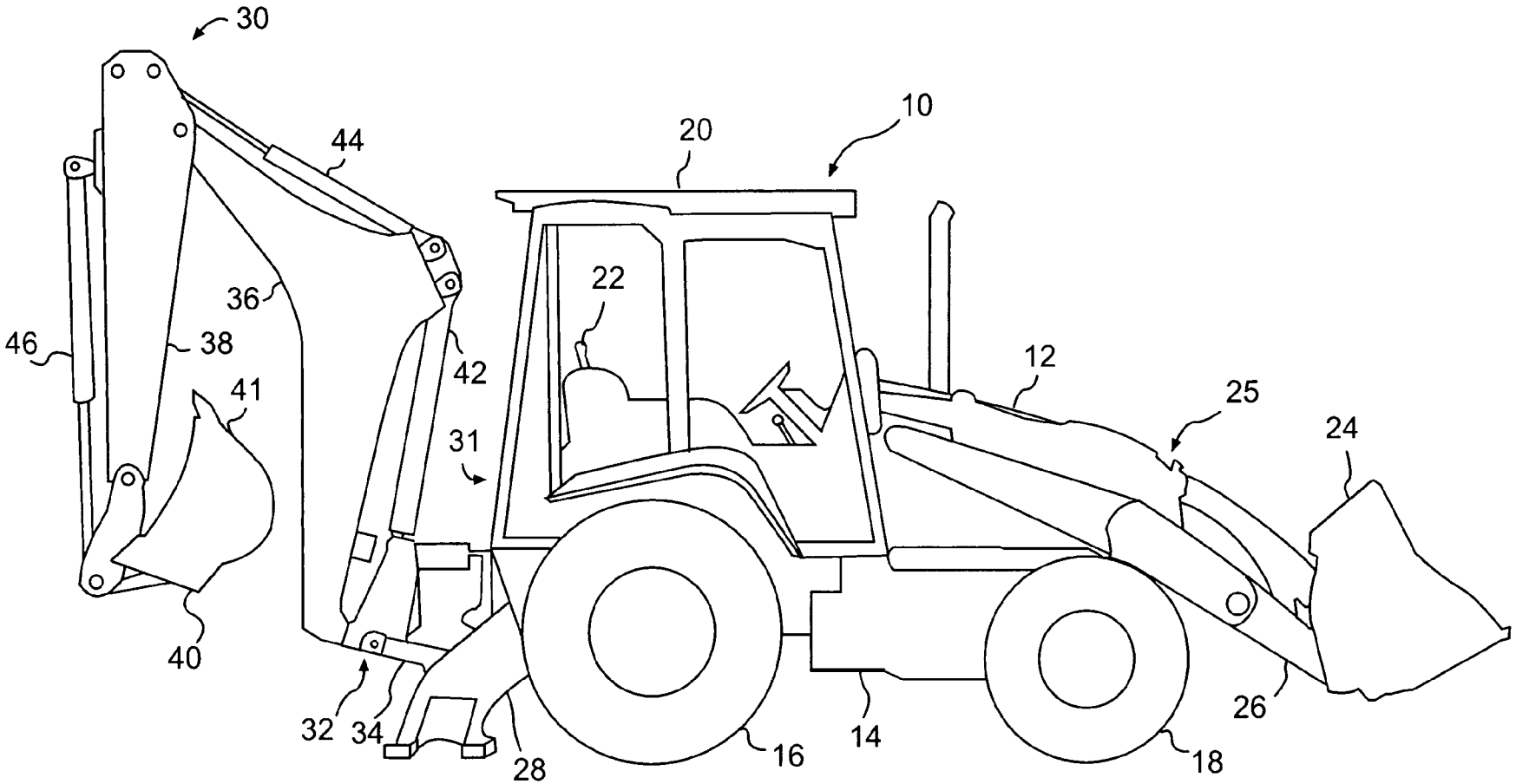
FIG. 1 is a generalized representation of a backhoe loader.

FIG. 1 illustrates an exemplary backhoe loader 10 that may be employed in connection with embodiments of the disclosure. Backhoe loader 10 may include a machine, such as a tractor 12, having a chassis 14. The tractor 12 may include ground transportation wheels, including a pair of rear wheels 16 and a pair of front wheels 18. It should be understood that, instead of wheels 16 and 18, the tractor 12 could be provided with a pair of tracks or other structure to permit transportation of the tractor. Backhoe loader 10 may also include a cab 20 or other suitable facilities to accommodate an operator. The cab 20 may include suitable controls for controlling operation of the backhoe loader 10. For example, the controls may include a joystick 22 for enabling the operator to interface with the control system of the machine.

The backhoe loader 10 may include a loader bucket 24 at a first end 25 of the tractor 12, and suitable operating linkage 26 for manipulation of the loader bucket 24. The backhoe loader 10 may include a pair of outriggers 28, 28' (see also FIG. 3), e.g., stabilizer legs, mounted adjacent a second end 31 of tractor 12. The outriggers 28, 28' may be hydraulically controlled in a relatively conventional manner to swing between a stored position, and an extended position in which they contact the ground.

The backhoe loader 10 may also include an excavating assemblage 30, for example, a backhoe mechanism, at the second end 31 of the tractor 12. The excavating assemblage 30 may include a suitable swing assembly 32 for permitting the backhoe mechanism to swing about a pivot from one side of the tractor 12 to the other. The swing assembly 32 may move under the control of one or more hydraulic cylinders, such as hydraulic cylinder 34, and may serve to move the excavating assemblage 30 from an excavating position to a dumping position.

The excavating assemblage 30 may include a boom 36 having a first end pivotally mounted adjacent the tractor 12 for movement in a generally vertical plane. A stick 38 may have a first end pivotally mounted adjacent the second end of the boom 36 for movement in the same generally vertical plane in which the boom 36 may move. An excavating implement, for example, in the form of a bucket 40, may be pivotally mounted at a second end of the stick 38 for pivotal movement in the same generally vertical plane in which the boom 36 and stick 38 may move. Bucket 40 may be a relatively conventional backhoe bucket with a heel portion 41. The boom 36 may be pivotally moved under the control of a hydraulic cylinder 42. The stick 38 may be pivotally moved under the control of a hydraulic cylinder 44. The bucket 40 may be pivotally moved under the control of a hydraulic cylinder 46.

Figure 2:
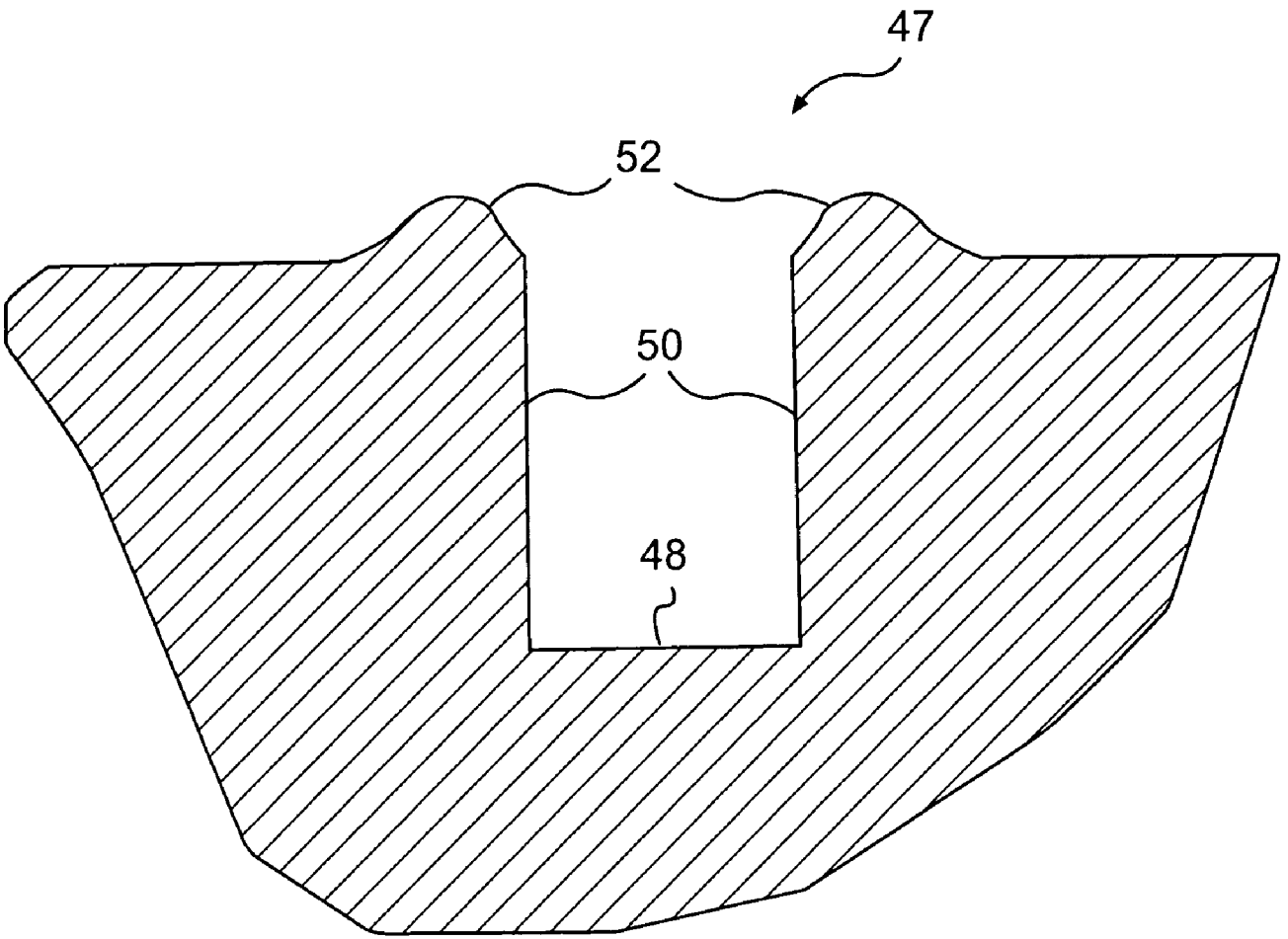
FIG. 2 illustrates a trench profile showing the position of off-fall.

FIG. 2 illustrates a typical trench profile 47 which may be formed by the excavating assemblage 30 during excavation. In general, the trench profile 47 may include a desired bottom profile 48 and a pair of sides 50. While not ordinarily a matter of purposeful design, a typical trench profile 47 may also include off-fall 52 forming upwardly protruding accumulations of loose material generally in rows along one or both edges of the trench. Off-fall 52 may result when bucket 40 pulls above ground level to discharge a load, and soil is pushed to the sides of the trench. Off-fall 52 may also result from spillage from the bucket 40 that may occur as the bucket lifts from the trench and moves to a dumping position laterally of the trench. The off-fall 52 may remain loose and subject to being readily dislodged to fall back into trench profile 47 unless removed or compacted.

Figure 3:
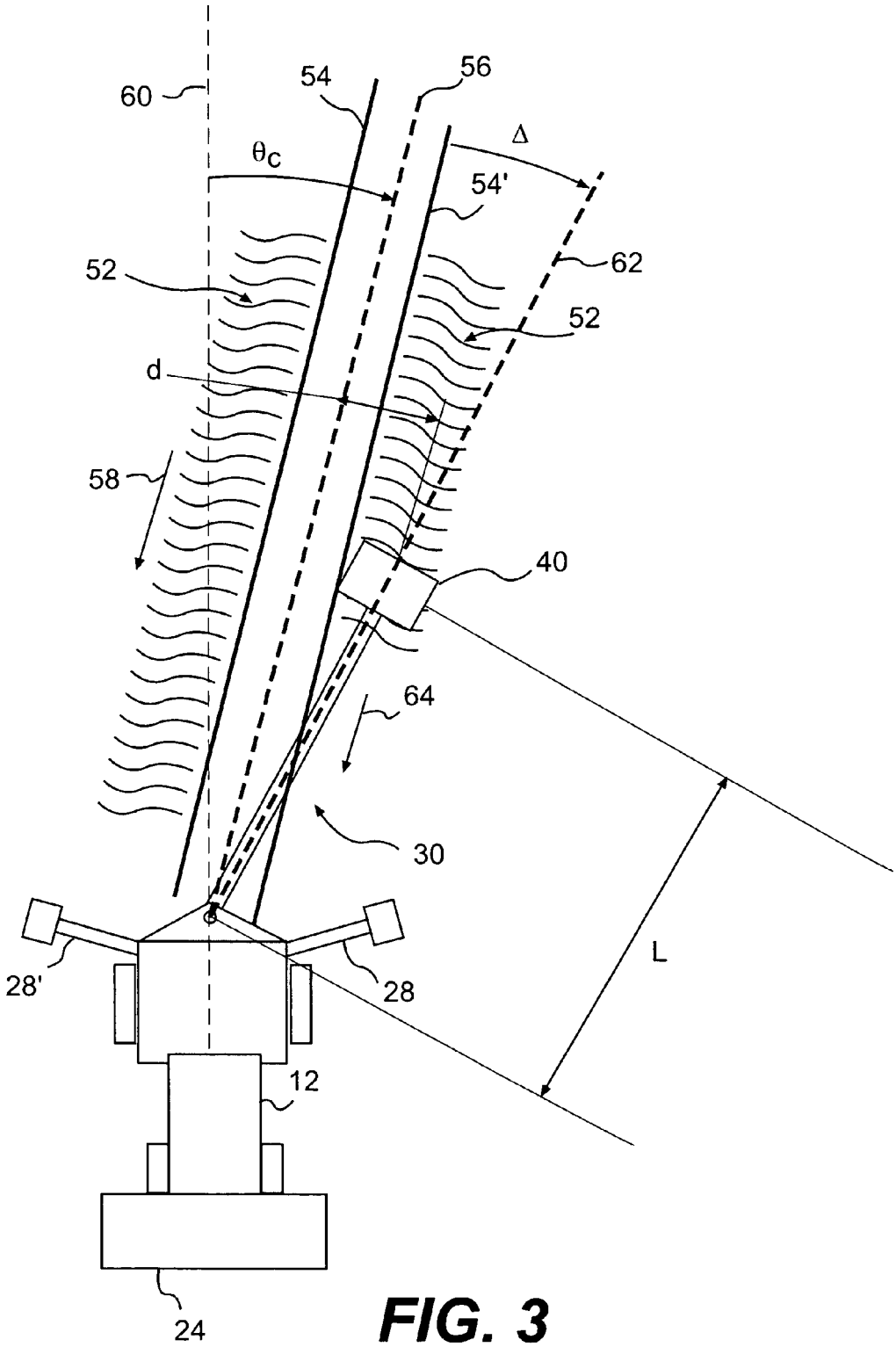
FIG. 3 is a diagrammatic plan view according to an embodiment of the disclosure.

FIG. 3 is a diagrammatic illustration of a tractor 12, for example the tractor of a backhoe loader, set up in position for excavating an elongated trench. Tractor 12 may be anchored in position by the outstretched outriggers 28, 28', aided by the loader bucket 24. In other words, the two outstretched outriggers 28, 28', along with the loader bucket 24, pressed firmly against the ground by the linkage mechanism 26, may hold the tractor 12 in a stationary position while the excavating assemblage 30 performs trenching operations within the range of movement of the pivotally mounted boom 36, stick 38, and bucket 40. The trench is diagrammatically shown in FIG. 3 with trench edges 54, 54' and trench centerline 56. The direction in which digging along the trench proceeds is represented in FIG. 3 by the arrow 58.

FIG. 3 also illustrates certain exemplary relationships that may exist between an excavating assemblage, a tractor, and a trench being excavated according to an embodiment of the disclosure. Dashed line 60 represents an extension of the longitudinal axis or centerline of the tractor 12. While practice may ordinarily indicate that the tractor 12 be set up longitudinally aligned with the trench 12, this may not always be practical. For example, trenching close to a building or other obstruction may require that the tractor 12 be set up at an angle to the trench. The tractor 12 may be set up and anchored for a phase of excavation with the longitudinal axis 60 of tractor 12 offset by an angle $\theta c$ from the trench centerline 56.

Dashed line 62, still referring to FIG. 3, represents an extended centerline of the excavating assemblage 30 including boom 36, stick 38, and bucket 40. In FIG. 3, bucket 40 is illustrated in a position above a row of off-fall 52 along edge 54' of the trench. Off-fall 52 is illustrated in FIG. 3 adjacent and along the edges 54, 54' of the trench in rows running generally parallel to the trench. The angle between the trench centerline 56 and the centerline of the excavating assemblage 30 is designated $\Delta$. The distance from the centerline 56 of the trench to the approximate center of bucket 40 at heel portion 41 measured perpendicular to centerline 56 is designated d. The distance between the pivotal attachment of the excavating assemblage 30 to the tractor 12, and the nominal center of bucket 40 when positioned on off-fall 52, is shown as L.

Excavating assemblage 30 may be programmed to operate in an off-fall control mode to either remove off-fall or to compact off-fall. For example, the machine operator may select either a removal mode, or a compaction mode, by activating a suitable input mechanism programmed to place the machine into the selected mode. It is also contemplated that the machine operator may select a mode including both removal, over portions of the off-fall, and compaction, over other portions of the off-fall. The input mechanism could be buttons, a touch screen, or any other suitable input mechanism known to those skilled in the art.

When the excavating assemblage 30 is operated to remove the off-fall 52, bucket 40 is moved into contact with or adjacent the off-fall and positioned with the bottom of the bucket 40, between heel 41 and the cutting edge, generally parallel to the ground. The control mechanism, from calculations based on one or more of the angles θc and Δ, and, for example, the continuous measurement of the relative angles of the boom 36, stick 38, bucket 40, and swing mechanism 32, may move the bucket 40 from its starting point relatively extended away from the tractor, along the row of off-fall 52 generally parallel to the edge 54' of the trench in a removal direction indicated by arrow 64 for a given range of movement and to a position more closely adjacent tractor 12. In this way, the off-fall 52 is scooped up into bucket 40. The edge of the trench is thereby cleaned by removal of off-fall 52. The removed off-fall may accumulate near the base of tractor 12 for removal or compaction after the next machine set-up, or it may be dumped at a position away from the trench. Small amounts of off-fall may remain in bucket 40 until the excavating assemblage makes a subsequent digging pass.

When the excavating assemblage 30 is operated to compact the off-fall 52, the heel portion 41 of bucket 40 is moved into contact with the off-fall by adjusting the angle of curl of the bucket 40 via hydraulic cylinder 46, for example, until heel portion 41 is suitably positioned. Control system 66 (FIG. 4), from calculations based on one or more of the angles θc and Δ, and, for example, the continuous measurement of the relative angles of the boom 36, stick 38, bucket 40, and swing mechanism 32, may move the heel portion 41 of bucket 40 along the row of off-fall 52 generally parallel to the edge 54' of the trench in a compaction direction indicated by arrow 64 for a given range of movement and to a position more closely adjacent the tractor. In this way, the off-fall 52 is compacted by heel portion 41 of bucket 40. The edge of the trench is thereby effectively cleaned of loose off-fall by compaction of off-fall 52.

Figure 4:
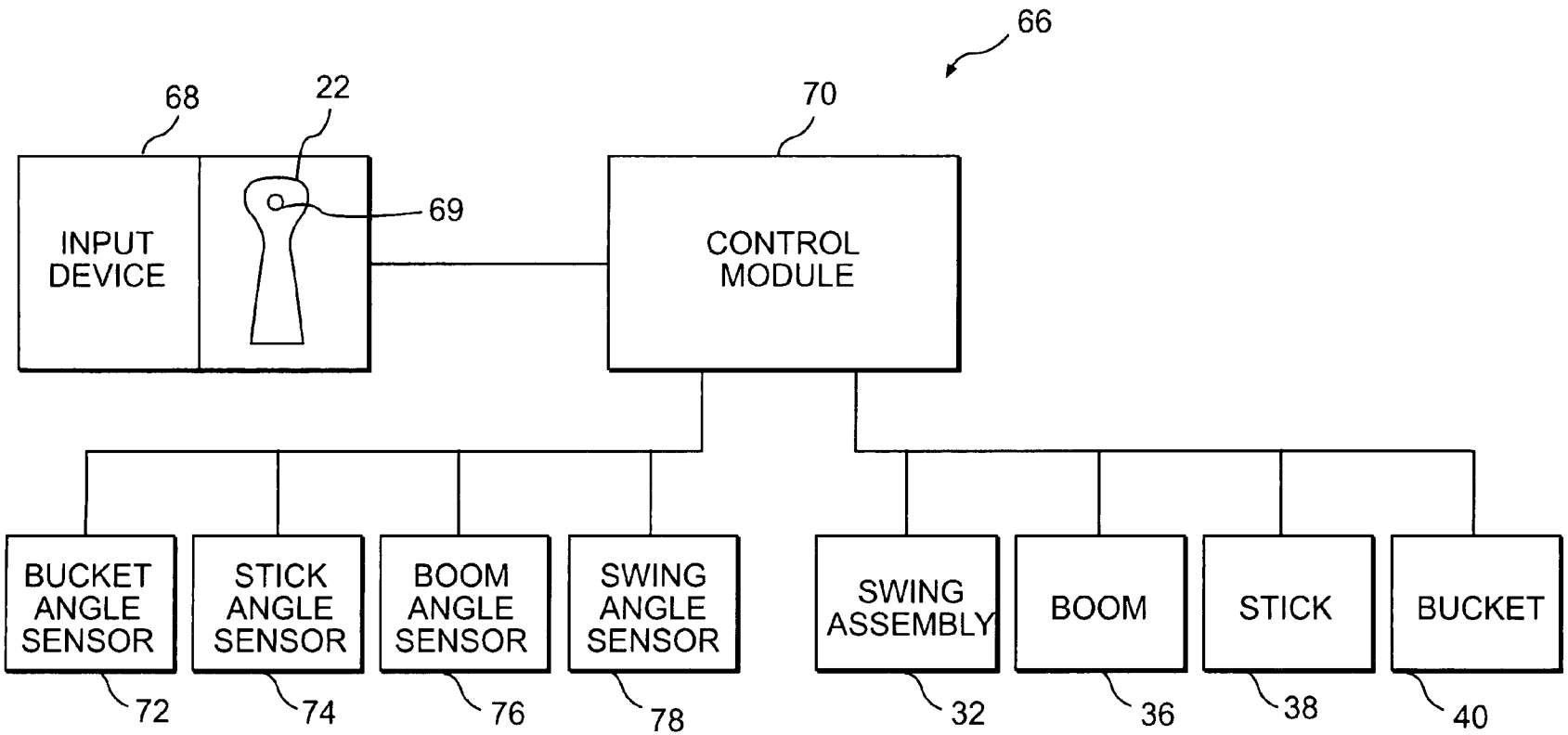
FIG. 4 is a control diagram according to an embodiment of the disclosure.

FIG. 4 diagrammatically illustrates a control system 66 that may be employed in operating excavating assemblage 30 in an automated off-fall control mode for removal and/or compaction of off-fall 52. An input device 68 may serve to enable operator input to the control system 66. Diagrammatically illustrated input device 68 may include various expedients permitting an operator to interface with the control system 66. For example, the input device 68 could include a button or buttons conveniently positioned. As another example, the input device 68 could include a touch screen display. Various other input devices known to those skilled in the art may be employed to enable the operator to interface with control system 66.

Input device 68 may be housed within cab 20 of tractor 12. Schematically illustrated in FIG. 4 as an exemplary component of input device 68 is joystick 22 and an associated button 69 located on joystick 22. Button 69 is an example of an input device that may be suitably configured to initiate and/or terminate an automated off-fall control mode according to a disclosed embodiment. If a button, such as button 69, is employed as an input device, the button may be located at the base of the joystick, on a control panel, or at any location convenient to an operator. In lieu of, or in addition to, a button, a touch screen may be employed and suitably configured to initiate and/or terminate an automated off-fall control mode. Input device 68 may generate a signal directed to control module 70.

Control module 70 may include a processor and memory as known in the art. The memory may store one or more routines, which could be software programs, for controlling the excavating assemblage 30 as well as other machine components. For example, the memory may store routines for controlling excavating assemblage 30 in an off-fall control mode for removal and/or compaction of off-fall. Control module 70 may be configured to receive information from input device 68, and from various sensors that may be associated with the excavating assemblage 30 or other machine components. For example, in connection with operation of excavating assemblage 30 in an automated off-fall control mode, various angle sensors may be included for determining the various angles between cooperating components.

In FIG. 4, for example, bucket angle sensor 72, stick angle sensor 74, boom angle sensor 76, and swing angle sensor 78 are schematically illustrated. Bucket angle sensor 72 may determine the angle of bucket 40 relative to stick 38. Stick angle sensor 74 may determine the angle of stick 38 relative to boom 36. Boom angle sensor 76 may determine the angle of boom 36 relative to tractor 12 in a generally vertical plane, for example. Swing angle sensor 78 may determine the angle of boom 36 relative to tractor 12 in a generally horizontal plane, for example. If this is an excavator, such as a hydraulic excavator, sensor 78 could sense the rotation of the excavator relative to the lower body of the excavator. Control module 70 may be configured to receive and process input data from each of the various angle sensors and may be in operable communication with an electro-hydraulic system associated with control of the hydraulic cylinders 34, 42, 44, and 46, for the swing assembly 32, boom 36, stick 38, and bucket 40, respectively.

An automated mode of control may direct the removal and/or compaction of the off-fall 52 by controlling the horizontal movements of the excavating assemblage while leaving the vertical (i.e., downpressure) control to the operator, or automated control may direct control in all directions of motion without operator intervention. The result may be, via control system 66, an automated off-fall control mode including automated control of the motion of the bucket, the height of the bucket, and the curl position of the bucket as it is pulled parallel to the trench centerline to remove and/or compact off-fall 52.

In one embodiment, there may be one input device for directing the automated mode of control of the excavating assemblage during off-fall removal and/or compaction, and a second input device to enable operator intervention to control generally vertical motion of a bucket. For example, a right-hand joystick may be employed to select and initiate automated off-fall control, while a left-hand joystick may be employed by the machine operator to intervene with control of vertical movement of a bucket where off-fall tends to be relatively uneven in distribution along the edge of the trench. In other words, if, along the edge of the trench, there is a mound of off-fall followed by a depression or low point in the off-fall, the operator may adjust bucket position in a generally vertical direction to ensure that the off-fall is compacted at both high points and low points of accumulated off-fall.

In another embodiment, excavating assemblage 30 may operate in a fully autonomous mode. For example, at any position of the bucket above the trench, activation of a suitable input device may initiate an automated off-fall control mode. Thereafter, control module 70 may control, via a suitable algorithm, all directions of movement of excavating assemblage 30. For example, swing assembly 32, boom 36, stick 38, and bucket 40 may be controlled to move to a start position relative to an off-fall accumulation along the edge of a trench. This may include both the necessary relatively horizontal movements to achieve a location over the off-fall accumulation, and the necessary relatively vertical movement to begin compacting or removing the off-fall. Control module 70 may also control the curl angle of bucket 40 for removal or for compaction of off-fall. Control module 70 may control movement of excavating assemblage 30 along the length of and generally parallel to the trench at a preset velocity. In controlling movement of excavating assemblage 30, control module 70 may suitably coordinate the actuators, for example, hydraulic cylinders, for the swing assembly 32, boom 36, stick 38, and bucket 40.

Off-fall 52 may accumulate on both sides of the trench along edges 54, 54' as illustrated in FIG. 3. It may be desired, depending on factors including the location of the trench relative to obstructions, to initiate an automated mode for removal and/or compaction of off-fall 52 on both sides of the trench. In such a situation, upon removal and/or compaction of off-fall 52 on one side of the trench, there is a repetition of the process of positioning the bucket 40, and/or heel portion 41 of bucket 40 if compaction is desired, on the off-fall on the other side of the trench and initiation of an automated off-fall control mode and movement along the row of off-fall generally in the direction 64.

In another embodiment, it may be desirable to control off-fall by removal and/or compaction on both sides of a trench in a single operation. For example, a machine operator may activate a suitable input device, for example, a button on a joystick, and initiate an automated mode of off-fall control whereby control module 70 controls excavating assemblage 30 to move along one side of the trench to remove and/or compact off-fall, swing to the other side of the trench, and then move along the other side of the trench to compact and/or remove off-fall.

In this embodiment, control module 70 may remove and/or compact off-fall by controlling movement of a bucket from a start position to a position adjacent tractor 12, then controlling swing assembly 32 to move the excavating assemblage to the other side of the trench. Once swing assembly 32 has moved excavating assemblage 30 to the other side of the trench, the operation may continue with control module 70 controlling movement of the bucket away from the tractor in a compaction mode toward an end point generally extended from the tractor. Alternatively, when the swing assembly 32 has move excavating assemblage 30 to the other side of the trench, control module 70 may control movement of the bucket away from the tractor to a point generally extended from the tractor, and then control movement of the bucket back toward the tractor with the bucket positioned to remove and/or compact the off-fall on that side of the trench.

In another embodiment, the off-fall control mode may be less than fully automated. For example, movements of the swing assembly 32, boom 36, stick 38, and bucket 40 may all be automated and controlled by control module 70 for movement coordinated to compact and/or remove off-fall, but the machine operator may retain the ability to control the speed of movement of the bucket along the off-fall via a suitable input device, such as, for example, a joystick. In this embodiment, the operator may retain the option to start and stop the automated movement at one or more points along the row of off-fall.

In another embodiment of a less than fully automated off-fall control mode, a machine operator may retain the ability to input a command to alter movement of bucket 40 in the generally vertical direction. For example, a suitable input device, such as, for example, a joystick, may enable an operator to intervene by issuing a command to control module 70 to move bucket 40 slightly higher or lower than the level calculated within the control module as the appropriate level for automated off-fall control. In this embodiment, control module 70, upon operator intervention with a command, may permit the operator, via a joystick, for example, to give an input to change the target height of bucket 40 relative to the off-fall, but not to have direct command over boom or stick movement. The algorithm for automated off-fall control, in this embodiment, would exercise appropriate joystick control to ensure that the operator utilizing the joystick could give input to the algorithm for the generally vertical movement of bucket 40.

In another embodiment of a less than fully automated off-fall control mode, a machine operator may retain the ability to select the target generally vertical position of bucket 40 relative to off-fall 52, and the ability to select the curl angle of bucket 40. In this embodiment, the operator may position the bucket at the start location on or adjacent the off-fall, positioning the bucket at the correct height and the correct curl angle appropriate for either compacting with the heel portion 41 of the bucket, or in a position for removing the off-fall by, for example, scooping it into the bucket. Once the operator has so positioned the bucket, control module 70 may then direct movement of the bucket in its movement along the path of the off-fall in an automated control mode while maintaining the height of the bucket and the curl angle of the bucket established by the operator.

INDUSTRIAL APPLICABILITY

Figure 5:
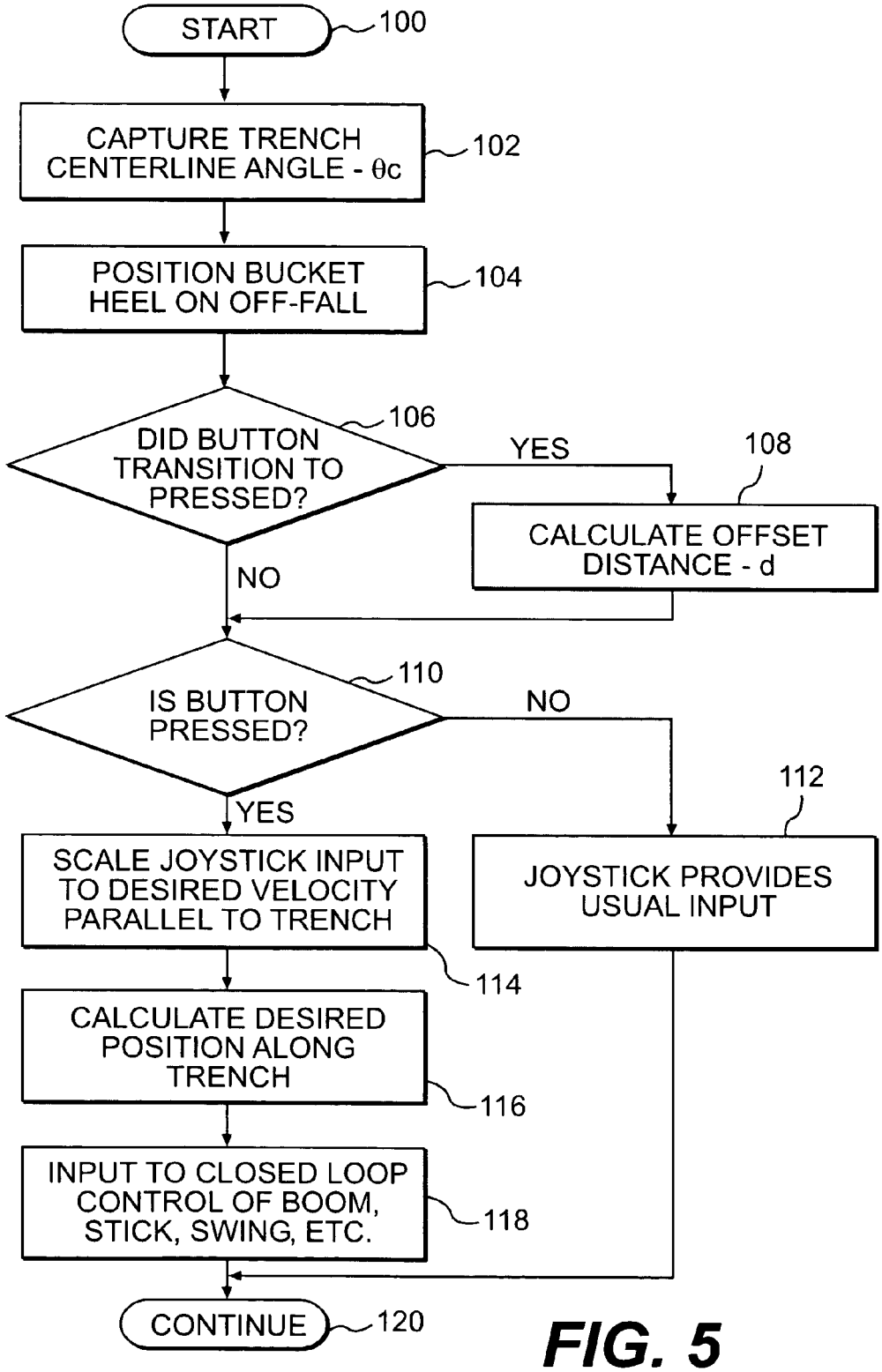
FIG. 5 is a flow chart according to a disclosed embodiment.

Referring to the flow chart illustrated in FIG. 5, a process according to a disclosed embodiment may begin at 100. At 102, the angle θc between machine centerline 60 and trench centerline 56 (see FIG. 3) may be determined. This angle may be calculated, for example, by an angle sensor, such as, for example, angle sensor 78, that measures the horizontal angle of the boom 36, when boom 36 is directly over the trench being excavated, relative to the longitudinal axis 60 of tractor 12 in its set-up position for excavating. This gives a frame of reference for subsequent measurements and calculations. Angle θc may be any angle from 0° up to approximately 90°, and may open to either side of the trench, depending on the set-up orientation of the tractor 12. Generally, angle θc may be captured once at each set-up of the tractor 12 for a trenching phase.

At 104, the operator, after trenching has proceeded for a time and off-fall 52 has accumulated along the edge 54 and/or 54', positions the bucket for off-fall control. If removal of off-fall is desired, bucket 40 may be positioned on or adjacent the off-fall 52 that has accumulated along the edge 54 or 54' of the trench. If compaction of off-fall is desired, heel portion 41 of the bucket 40 may be positioned on the off-fall 52 that has accumulated along the edge 54 or 54' of the trench.

At 106, a decision is made whether the operator has pressed a button, such as, for example, button 69 mounted on joystick 22, or interfaced with a touch screen or other suitable control expedient, to instruct the control module 70 to initiate an automated off-fall control mode for off-fall 52. If the operator has pressed the button or interfaced with another suitable control expedient, indicating an intent to initiate removal and/or compaction of the off-fall 52, the offset distance d, representing the distance between the trench centerline 56 and the approximate center of bucket 40, is calculated at 108. This distance d may be derived from measurement of the angle Δ (see FIG. 3) by, for example, a suitable angle sensor such as, for example, angle sensor 78, and measurement of distance L. Calculation of the offset distance d may be provided only when the set-up angle of the tractor 12 has been altered relative to the trench centerline, or when the direction of the trench has changed.

At 110, a decision is once again made whether the button has remained pressed, or whether the designated control element (e.g., touch screen) has remained activated, so as to initiate an automated off-fall control mode. If at this stage the answer is "No," indicating, for example, that the operator has decided to interrupt the automation routine, then no automated mode for off-fall removal and/or compaction ensues. Rather, the operator retains control and gives usual input by way of suitable controls such as, for example, joystick 22. This permits the operator to use discretion, as conditions indicate, to by-pass a particular off-fall removal or compaction phase, to perform some other desired operation with the excavating assemblage, or to initiate off-fall removal or compaction under his or her own control. On the other hand, if the answer is "Yes," then an automated mode for off-fall removal and/or compaction is initiated.

At 114, the system may adjust for a desired velocity of movement of the bucket 40 along the row of off-fall 52 parallel to the trench by scaling the joystick 22 input. Numerous factors, such as material consistency and amount of off-fall, may affect how fast the removal and/or compaction operation should proceed. Then, based on the known machine parameters and the measurements of the relative angles between boom 36, stick 38, bucket 40, as well as the swing angle between the excavating assemblage 30 and the tractor 12, the desired position for the end of off-fall 52 removal and/or compaction in a given control phase is calculated at 116.

At 118, the relevant hydraulic cylinders 34, 42, 44, 46, for the swing mechanism 32, boom 36, stick 38, and bucket 40, respectively, may be controlled to implement the removal or compaction of the row of off-fall 52 within the limits of the current machine set-up. Here, the various components of excavating assemblage 30, based on instruction from control module 70, are caused to function in coordination so as to move bucket 40, or heel portion 41 of bucket 40, along a row of off-fall 52 generally parallel to the trench and toward tractor 12. If desirable, removal and/or compaction of off-fall 52 at the opposite side of the trench may then be initiated through a similar sequence. If desired, off-fall may be removed at one side of the trench and compacted at the other side of the trench. In some instances, both removal and compaction of off-fall may occur on the same side of the trench.

At 120, the process of excavating the trench proceeds. From 120, the sequence may return to a position downstream of the start position 100 such as, for example, to 104 where it is desired to initiate removal and/or compaction of the off-fall 52 along the opposite edge of the trench. It may also be desirable in certain circumstances, depending, for example, on the consistency and/or amount of off-fall 52, to initiate a second or subsequent pass over a row of off-fall 52. It will be understood that control module 70 could be suitably programmed to automatically initiate second or subsequent passes under an automated control mode.

It will be understood that the process schematically illustrated in FIG. 5 and described above is an exemplary embodiment which may vary, depending, for example, on the particular automated mode of off-fall control is initiated, and depending on the particular input device utilized. For example, where removal of off-fall is desired, the bucket may be positioned adjacent off-fall instead of on off-fall at 104. As another example, at 106 and 110, where a touch screen or other input device is utilized, the process may involve determining whether the touch screen or other input device is activated, rather than whether a button is pressed.

It will be understood that trenching by an excavating assemblage, such as a backhoe mechanism, may be carried out in phases wherein the machine is repositioned intermittently as the trenching operation progresses. In the case of the usual trench exceeding the working extent of the backhoe mechanism during a given set-up of the tractor, the tractor may be moved repeatedly and set up in position for continued trenching. When the trenching proceeds in this fashion, that is, by trenching for a predetermined time, setting up, and again trenching, the removal and/or compaction of off-fall may proceed in a similar manner. Accordingly, the off-fall accumulated during a given set-up of the tractor may be removed or compacted after trenching for that set-up has been completed, but just before the tractor is set up for the next phase of trenching.

By utilizing an automated system for control of the off-fall 52 which may accumulate along the edge or edges of a trench being excavated, there is a reduced risk of off-fall inadvertently reentering the trench. Because the removal and/or compaction process is accomplished by the trenching machine as the trenching process proceeds, any interruption of productivity in the trenching operation is offset by the early elimination of the opportunity for loose off-fall to work its way back into the trench. In addition, the much less desirable and more labor intensive alternative of removing the off-fall manually or by other equipment is avoided. The trench bottom profile is thus kept essentially free of off-fall, and there is less chance that subsequent activities, such as those associated with concrete pouring operations, will receive interference from off-fall.

While the disclosed system and method have been disclosed in connection with a typical backhoe loader, it should be understood that other types of excavating assemblages, such as a hydraulic excavator, for example, may benefit from employing the disclosed system and method.

It will be apparent to those skilled in the art that various modifications and variations can be made to the disclosed off-fall control system and method without departing from the scope of the disclosure. Other embodiments will be apparent to those skilled in the art from consideration of the specification and practice of the disclosed embodiments. It is intended that the specification and examples be considered as exemplary only with the true scope of protection being indicated by the following claims.

What is claimed is:

1. A method of controlling off-fall during a trenching operation of an excavation machine having an excavating assemblage including a boom, stick and bucket, comprising:

positioning the machine and operating the excavating assemblage to excavate a trench having opposing first and second sidewalls, each sidewall having an upper edge including an off-fall;

positioning the excavating assemblage over the trench to set a trench centerline;

horizontally moving the excavating assemblage and positioning the bucket adjacent the off-fall of the first sidewall;

providing an initiation signal to an electronic control module to initiate an automatic off-fall control mode;

providing position signals indicative of the position of the boom, stick, and bucket to the electronic control module; and after the off-fall control mode has been initiated, providing control signals from the electronic control module for automatically operating the excavating assemblage to move the bucket along the off-fall substantially parallel to the trench centerline to remove or compact the off-fall.

2. The method of claim 1, further comprising curling the bucket to position a heel of the bucket to contact the off-fall.

3. The method of claim 1, further comprising adjusting a velocity of the excavating assemblage for the off-fall control mode via an operator velocity signal.

4. The method of claim 1, wherein the excavating assemblage is operated to move the bucket along the off-fall from a first extended position to a second position closely adjacent the machine.

5. The method of claim 4, further comprising adjusting the vertical position of the bucket via an operator assemblage control signal while the excavating assemblage is operated automatically to move the bucket along the off-fall.

6. The method of claim 4, further comprising:

horizontally moving the excavating assemblage and positioning the bucket adjacent the off-fall of the second sidewall and repeating the step of providing control signals from the electronic control module for operating the excavating assemblage to move the bucket along the off-fall substantially parallel to the trench centerline to remove or compact the off-fall of the second sidewall.

7. The method of claim 6, wherein horizontal movement of the excavating assemblage from the first to the second sidewall occurs automatically.

8. The method of claim 1, further comprising calculating an offset distance of the bucket to the trench centerline.

9. A machine for excavating a trench and controlling off-fall positioned along upper edges of first and second side walls of the trench, comprising:

a chassis;

an excavating assemblage including a boom operatively connected to the chassis, a stick pivoted to the boom, and a bucket pivoted to the stick;

a control module configured to receive a first signal indicative of a boom pivot angle, a second signal indicative of a stick pivot angle, a third signal indicative of a bucket pivot angle, and a fourth signal indicative of a horizontal position of the excavating assemblage, the control module further configured to operate in an automated off-fall control mode by automatically controlling the excavating assemblage to move the bucket along the off-fall of the upper edge of the first side wall of the trench.

10. The machine of claim 9, further comprising an operator control to initiate operation of the off-fall control mode.

11. The machine of claim 9, wherein the horizontal position of the excavating assemblage is achieved by pivoting the boom relative to the chassis.

12. The machine of claim 9, wherein the machine further includes a body configured for rotational movement relative to the chassis, wherein the boom is connected to body for pivotal movement in a vertical direction, and wherein the horizontal position of the excavating assemblage is achieved by rotational movement of the body.

13. The machine of claim 9, wherein the controller is configured to automatically move the bucket along the off-fall from a first extended position to a second position closely adjacent the machine.

14. The machine of claim 9, wherein the controller is further configured to calculate an offset distance of the bucket to a trench centerline.

15. The machine of claim 9, wherein the controller is configured to move the bucket along the off-fall of the upper edge of the first side wall of the trench parallel to a centerline of the trench.

16. The machine of claim 9, further including an operator control device configured to provide a signal to control the vertical position of the bucket while the controller moves the bucket along the off-fall of the upper edge of the first side wall of the trench.

17. The machine of claim 9, wherein the machine is a backhoe-loader, the backhoe loader further comprising a pair of outriggers mounted adjacent a first end of the chassis.

18. A backhoe loader for excavating a trench and controlling off-fall positioned along upper edges of first and second side walls of the trench, comprising:

a chassis having a first end and a second end;

an operator's station supported by the chassis;

a loader bucket operatively connected by a linkage to the first end of the chassis;

an excavating assemblage including a boom having a first end and a second end, the first end pivotally connected to the chassis and configured for pivotal movement in a horizontal and vertical direction, a stick having a first end pivotally connected to the second end of the boom, and a second end pivotally connected to a bucket;

an operator control mechanism for manually controlling operation of the excavation assemblage;

an off-fall control mode selector configured to provide an initiation signal to initiate an off-fall control mode;

a control module configured to receive a first signal indicative of a vertical boom pivot angle, a second signal indicative of a stick pivot angle, a third signal indicative of a bucket pivot angle, and a fourth signal indicative of a horizontal boom pivot angle, the control module further configured to operate the off-fall control mode by automatically controlling the excavating assemblage to move the bucket along the off-fall of the upper edge of the first side wall of the trench from a first extended position to a second position closely adjacent the machine.

19. The backhoe loader of claim 18, wherein the controller is further configured to upon movement of the bucket to the second position, to automatically move the excavating assemblage to a second side wall of the trench and to position the bucket in a third extended position to repeat the process of off-fall control for the second side wall.

* * * * *